US008856977B2

(12) United States Patent
Ramirez

(10) Patent No.: US 8,856,977 B2
(45) Date of Patent: Oct. 14, 2014

(54) URINAL SPLASH GUARD EMPLOYING FLEXIBLE BRISTLES

(76) Inventor: Ed Ramirez, San Ramon, CA (US)

( * ) Notice: Subject to any disclaimer, the term of this patent is extended or adjusted under 35 U.S.C. 154(b) by 2409 days.

(21) Appl. No.: 11/438,945

(22) Filed: May 22, 2006

(65) Prior Publication Data

US 2007/0266486 A1 Nov. 22, 2007

(51) Int. Cl.
*E03D 13/00* (2006.01)

(52) U.S. Cl.
CPC ..... *E03D 13/00* (2013.01); *E03D 13/005* (2013.01)
USPC ..... 4/309

(58) Field of Classification Search
CPC ..... E03D 9/08; E03D 13/00
USPC ..... 4/222.1, 309, 300, 661, 300.3, 443
See application file for complete search history.

(56) References Cited

U.S. PATENT DOCUMENTS

| | | | | |
|---|---|---|---|---|
| 2,211,970 | A | 8/1940 | Fischer | |
| 3,597,772 | A * | 8/1971 | Leavitt et al. | 4/222 |
| 4,098,116 | A | 7/1978 | Browne | |
| 4,557,863 | A | 12/1985 | Callewaert et al. | |
| 4,574,403 | A | 3/1986 | Dintemann et al. | 4/309 |
| 4,604,357 | A | 8/1986 | Callewaert et al. | |
| 4,750,219 | A | 6/1988 | Williams | |
| 4,985,940 | A | 1/1991 | Jones | |
| 5,010,599 | A | 4/1991 | Nilsson | |
| D329,893 | S | 9/1992 | Luedtke et al. | |
| 5,309,578 | A | 5/1994 | Temple, Sr. | |
| 5,313,672 | A | 5/1994 | Luedtke et al. | 4/301 |
| 5,336,424 | A | 8/1994 | Van Vlahakis et al. | |
| 5,398,347 | A | 3/1995 | Luedtke et al. | |
| 5,489,415 | A | 2/1996 | Van Vlahakis et al. | |
| 5,496,300 | A | 3/1996 | Hirsch et al. | |
| 5,604,937 | A | 2/1997 | Davenport | 4/309 |
| D393,896 | S | 4/1998 | Wagner et al. | |

(Continued)

OTHER PUBLICATIONS

United States Patent & Trademark Office, Notice of Allowability for a Design Application mailed Mar. 17, 2011, U.S. Appl. No. 29/360,101, 2pgs.

(Continued)

*Primary Examiner* — Lori Baker
(74) *Attorney, Agent, or Firm* — Harness, Dickey & Pierce, P.L.C.

(57) ABSTRACT

A mat or other object for attenuating reflective spray during use of a urinal comprises a urine impingement region that includes a plurality of upstanding, flexible bristles. In one embodiment, each of the bristles: has an appropriate thickness and flexibility configured to flex when struck by a typical stream of urine, wherein adjacent bristles are separated from one another by a distance such that the typical stream of urine contacting a bristle and causing it to flex will also contact at least two adjacent bristles and cause them to flex as well; has a thickness and a height, wherein the thickness of each is less than one fifth of its height, and further wherein each bristle has at least three adjacent bristles within a distance of two times its thickness from it; is elongated, and the bristles are configured densely enough that an imaginary circle having a radius equal to a stream of urine's mean radius, centered on a given bristle, and drawn on the upper surface will include at least three other bristles within its boundary; or any combination of these. In some embodiments, the plurality of bristles that compose a urine retention region has an ordered arrangement, while in others plurality of bristles has a disordered arrangement.

12 Claims, 13 Drawing Sheets

(56) References Cited

U.S. PATENT DOCUMENTS

| | | | | |
|---|---|---|---|---|
| 5,774,905 | A * | 7/1998 | Wager et al. | 4/309 |
| 5,813,058 | A | 9/1998 | Quigley et al. | |
| 6,055,681 | A | 5/2000 | Lyons | 4/300.3 |
| D427,295 | S | 6/2000 | Wagner | |
| 6,265,084 | B1 | 7/2001 | Stickler | |
| 6,370,705 | B1 | 4/2002 | Levinson | |
| D464,122 | S | 10/2002 | Mangan | |
| 6,787,210 | B2 | 9/2004 | Stickler | |
| 6,862,754 | B1 | 3/2005 | DeMarco | |
| 6,920,648 | B1 | 7/2005 | Suski et al. | |
| D520,610 | S | 5/2006 | Wrate | |
| 2005/0144711 | A1 | 7/2005 | Valadez et al. | 4/309 |

OTHER PUBLICATIONS

Ritter, R.C., et al., "Analysis of Drop Intervals in Jets Modelling Obstruction of the Urinary Tract," pp. 161-170, downloaded on Jun. 8, 2010 from iopscience.iop.org , 1974 Phys. Med. Biol., vol. 19, No. 2.

Ritter, R.C., et al., "Physical Information in the External Urinary Stream of the Normal and Obstructed Adult Male," pp. 293-302, British Journal of Urology, 1977, 49.

Dugdale, David C. et al., "Medline Plus Uroflowmetry," 2 pgs., U.S. National Library of Medicine NIH National Institutes of Health, downloaded from www.nlm.nih.gov/medlineplus/ency/article/003325.htm on Sep. 2, 2010.

Gray, Henry, "Anatomy of the Human Body," Section 3b.4. The Male Urethra, 1918, pp. 1-3, http://www.bartlby.com/107/256.html.

* cited by examiner

URINAL SPLASH GUARD EMPLOYING FLEXIBLE BRISTLES

FIELD OF THE INVENTION

This invention relates generally to accessories for urinals and more specifically to anti-splash devices for urinals.

BACKGROUND

A urinal is a receptacle, typically constructed of porcelain or similar material, having substantially vertical walls above a collection basin that includes a drain. The smooth, nearly vertical walls provide a surface to receive a stream of urine from a man using the urinal. When the urinal is flushed, water is directed over the walls, into the collection basin and through the drain. The drain, usually positioned around the lowest point of the collection basin, receives urine during urination and flushing as well as water during flushing. Urinals are typically designed for mounting on restroom walls, though some urinals are configured for floor mounting.

Most urinals are designed to retain a residual amount of water in the drain area of the collection basin, which dilutes urine collected there during urination. Often, a screen or a grid is used to cover the urinal drain and prevent any large debris deposited in the urinal from entering the drain. Sometimes, other drain designs are used to accomplish this same goal.

The porcelain construction of most urinals makes for hard-surfaced walls and collection basins. These hard surfaces reflect or deflect some portion of any urine stream directed thereon, splashing droplets of urine away from the point where the stream and the surface meet. Further, a urine stream directed into the residual water typically present in the collection basin also will cause splashing, in this case of a urine-water mixture. Of course, most urinals are designed to retain much of the splashing caused during their use. However, splashing of some droplets out of the urinal is common, particularly when the urine stream impinges on the residual water. These stray droplets land on the user's clothing or hands, or on the restroom surfaces surrounding the urinal. Without some means for controlling this splashing, or frequent and rigorous cleaning, a urinal will eventually be accompanied by an unpleasant odor arising from urine droplets deposited on surrounding surfaces.

A variety of devices are designed for placement in a urinal to achieve a variety of ends. These goals include collecting solid debris and providing a fragrance or odor-absorbing chemical. Most common are drain mats intended to collect solid debris. Often these are simple pieces of flexible material containing small drain holes and configured over the urinal drain to catch any solid debris larger than the holes. A more versatile type of drain mat includes a holder configured to receive a deodorant urinal cake in addition to drain holes. The deodorant cake slowly dissolves, providing a fragrant, or odor absorbing, chemical to mask, or neutralize, the odor of urine that would otherwise emanate from the region surrounding the urinal. These cakes, or indeed the entire mat-cake system, are replaced periodically as the cakes dissolve away. Unfortunately, typical mats can increase splashing as such mats present an irregular surface to a urine stream.

Some in-urinal devices attempt to accomplish these common goals while simultaneously reducing the incidence of splashing. One of these is described in U.S. Pat. No. 5,313,672 to Luedtke et al., which describes a urinal mat provided with upstanding baffles to decelerate a stream of urine impinging thereon. The tiny upstanding baffles are spaced apart and formed from a flexible plastic material used to construct all parts of the mat. According to the teachings of Luedtke, the baffles' height is approximately the same order of magnitude as the spaces between them.

Unfortunately, this type of construction allows at least some portion of a urine stream to impinge on the mat surface without interruption, and relies on the presence of the baffles to break up any splash back produced. Furthermore, though the baffles are described as "flexible", Luedtke makes no teaching or suggestion that the baffles exhibit flexure under a stream of urine. In fact, Luedtke teaches equivalence between baffles that will not exhibit flexure under a stream of urine, e.g. pyramidal baffles, and those that might possibly do so, e.g. tiny hooks or cones supported on cylinders. By teaching this equivalence, Luedtke indicates that baffle flexure under a urine stream is an unimportant characteristic.

Hence, no prior invention teaches a urinal mat covered in densely packed bristles that exhibit flexure when struck by a stream of urine to inhibit splash back.

SUMMARY OF THE DISCLOSURE

In accordance with the present invention, a mat or other object for attenuating reflective spray during use of a urinal comprises a urine impingement region that includes a plurality of upstanding, flexible bristles.

In some embodiments, each of the bristles has an appropriate thickness and flexibility configured to flex when struck by a typical stream of urine, wherein adjacent bristles are separated from one another by a distance such that the typical stream of urine contacting a bristle and causing it to flex will also contact at least two adjacent bristles and cause them to flex as well.

In some embodiments, each of the bristles has a thickness and a height. The thickness of each is less than one fifth of its height; each bristle has at least three adjacent bristles within a distance of two times its thickness from it.

In some embodiments, each of the bristles is elongated, and the bristles are configured densely enough that an imaginary circle having a radius equal to a stream of urine's mean radius, centered on a given bristle, and drawn on the upper surface will include at least three other bristles within its boundary.

In accordance with some embodiments of the present invention, the plurality of bristles that compose a urine impingement region can have an ordered arrangement. In accordance with some embodiments of the present invention, the plurality of bristles that compose a urine impingement region can have a disordered arrangement.

Preferably, a urine impingement region in accordance with the present invention is disposed on an upper surface of a body configured for placement within a urinal that includes a sheet-like substrate having a plurality of drain holes. Also preferably, this body includes a lower surface configured to rest on a surface of a urinal in which it is placed. In some embodiments, portions of the body are infused with a chemical, such as a fragrance, deodorant, or anti-microbial, that is configured to leech out into the urinal over time.

In the preferred embodiment, the body also includes a void region disposed between the lower surface and the upper surface and configured to accept a urinal cake. Also in the preferred embodiment, a mat is an assembly, which comprises a body as described above and a retention member configured to couple with the body and retain a urinal cake within the void region.

In alternative embodiments, the mat is a different type of assembly. For example, in one alternative embodiment the mat comprises a body, as described above but without a void region, and a semi-cylindrical cap structure configured to accept a urinal cake. Preferably, the cap structure has a lid surface that includes a second urine impingement region, which can be of the same or of a different construction than the urine impingement region of the body, and a lower edge configured to interface with a urinal cake retention region on the upper surface of body, thereby permitting retention of a urinal cake therebetween.

Also in accordance with the present invention, a variety of methods of attenuating splashing caused by a stream of urine with a mean radius impinging on a urinal are disclosed. In general, these methods involve intercepting the stream of urine with a urine impingement region of an object disposed within the urinal. In various embodiments, the urine impingement region is constructed to have the various different characteristics described above. The step of intercepting is followed by a step of draining urine from the urine impingement region through an aperture. Preferably, at least a portion of the urine is drained onto a urinal cake.

DESCRIPTION OF THE SEVERAL FIGURES

DETAILED DESCRIPTION OF THE PREFERRED EMBODIMENT

The following section includes descriptions of several embodiments of the present invention and makes reference to the figures. The specific configurations discussed are only examples and do not serve to limit the scope of the invention. A person having ordinary skill in the relevant art will understand that the present invention can be practiced by using other configurations and arrangements of the various components of the illustrated embodiments.

Basic Function

Devices according to the present invention all serve two basic functions: that of a urinal drain mat and that of an anti-splash device. Further, some embodiments, including the preferred embodiment, serve to dispense fragrant, deodorant, or anti-microbial chemicals into the urinal in which they are placed.

Figure 1:
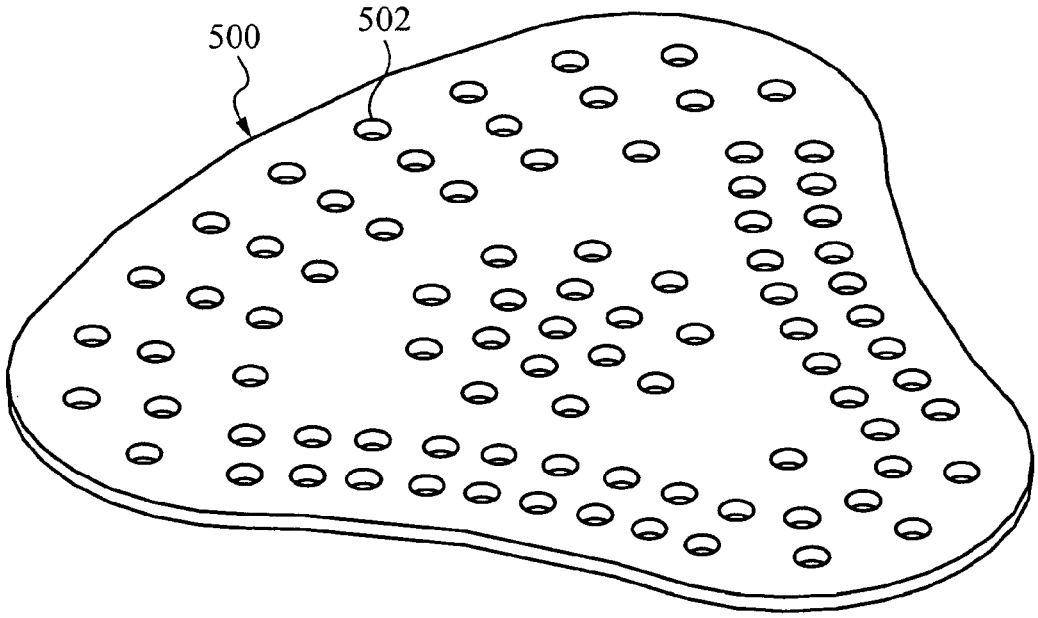
Fig. 1 (PRIOR ART)
FIG. 1 is a top perspective view of a typical urinal drain mat.

A urinal drain mat's basic function is to collect solid debris. Simple urinal drain mats are constructed of a flexible material and contain small drain holes. Typically, these drain mats are configured over the urinal drain to catch any solid debris larger than the holes. For example, the urinal drain mat 500 illustrated in FIG. 1 collects debris on its upper surface but allows fluid to pass through the holes 502.

Devices in accordance with the present invention also collect debris, but they perform another function as well: attenuating or preventing splashing during use of the urinal. These devices do so through their inclusion of special urine impingement zones adapted to absorb urine stream energy that could otherwise result in deflected droplets.

Further, some embodiments of the present invention include specialized features for dispensing chemicals into the urinal or its vicinity. For example, some embodiments include structures adapted to hold dissolvable urinal cakes. Some embodiments include implanted fragrance, deodorant, or anti-microbial chemicals that leech into the urinal over time.

Within the following description, identical reference numbers refer to the same, or to corresponding, elements.

Urinal Cake Holding Embodiments

Top Entry Configuration

Figure 2:
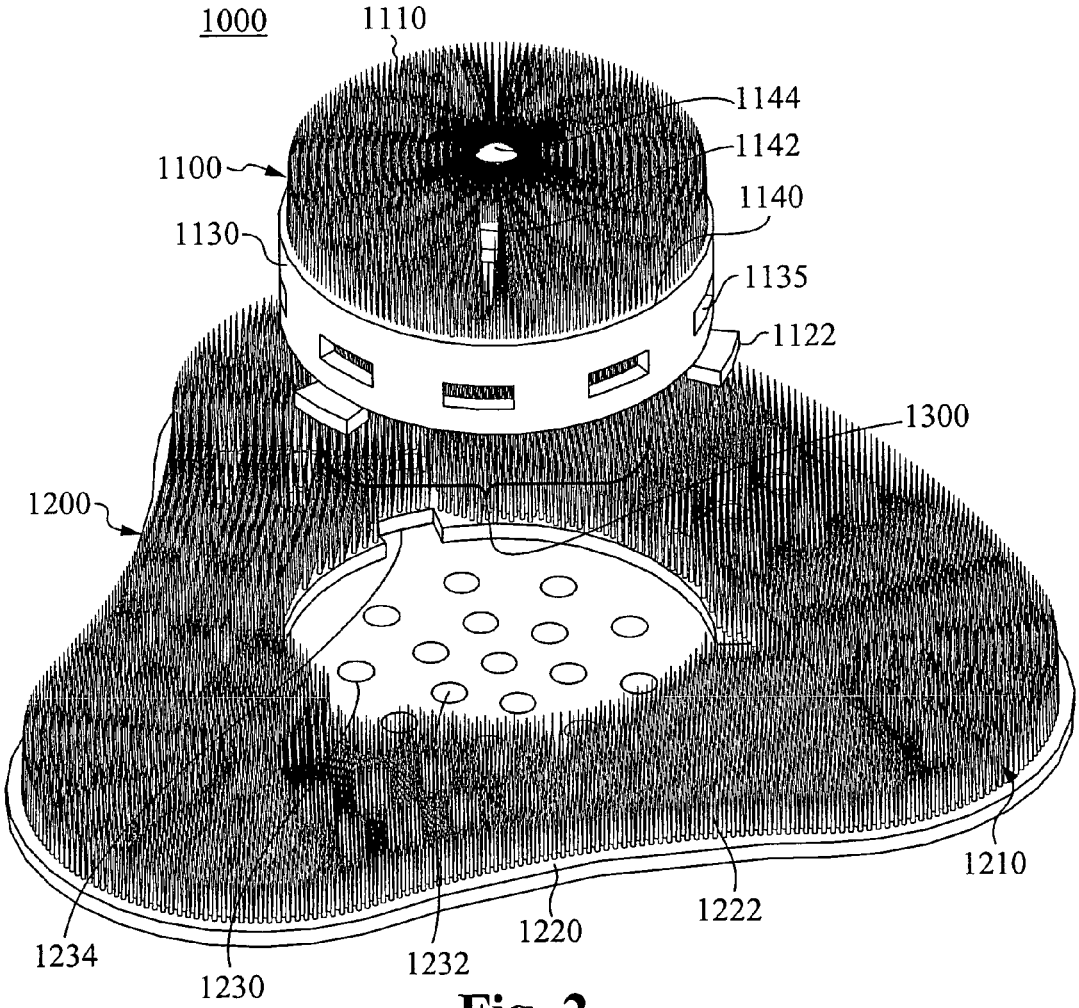
FIG. 2 is a top perspective exploded view of one embodiment of a urinal splash prevention device in accordance with the present invention.

FIG. 2 illustrates the anti-splash device 1000, in accordance with one embodiment of the present invention. The anti-splash device 1000 includes the cap structure 1100 and the base structure 1200.

Cap Structure

The cap structure 1100 includes a lid surface 1140, which contains a urine impingement region comprising a plurality of upstanding bristles 1110, and a wall surface. 1130. Further, the cap structure includes two types of drain holes: lateral vent holes 1135, which are formed through the wall surface 1130; and lid drain holes 1144 and 1142, which are formed through the lid surface 1140. Three retaining feet, including an exemplary retaining foot 1122, are attached to the base of the wall surface 1130 and are aligned so their upper surface (that closest to the point where the lid surface 1140 and wall surface 1130 intersect) is aligned with the lower edge of the wall surface 1130 (that portion most distal from the point where the lid surface 1140 and the wall surface 1130 intersect). The upper surface of each of the feet is flush with the base of the wall surface 1130.

Figure 6A:
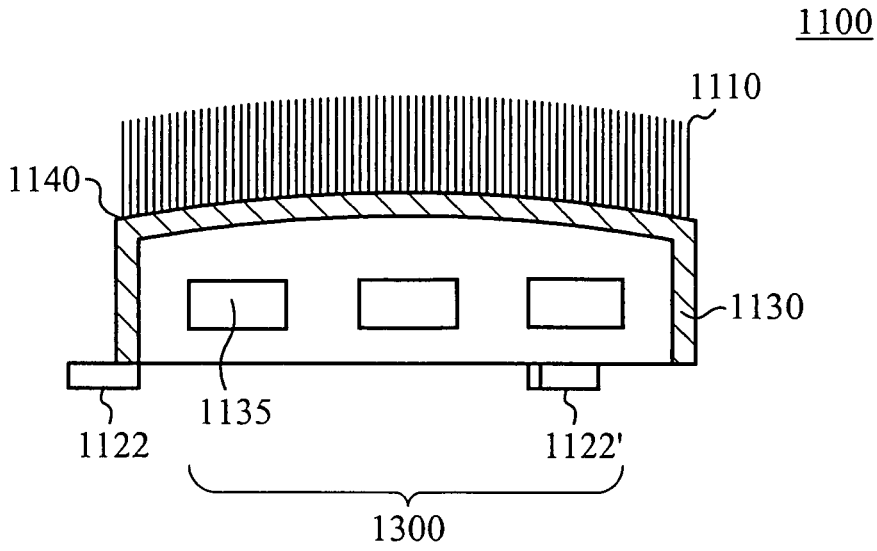
FIG. 6A is a cross sectional view of a cap structure of an alternative embodiment of a urinal splash prevention device in accordance with the present invention.
Figure 6B:
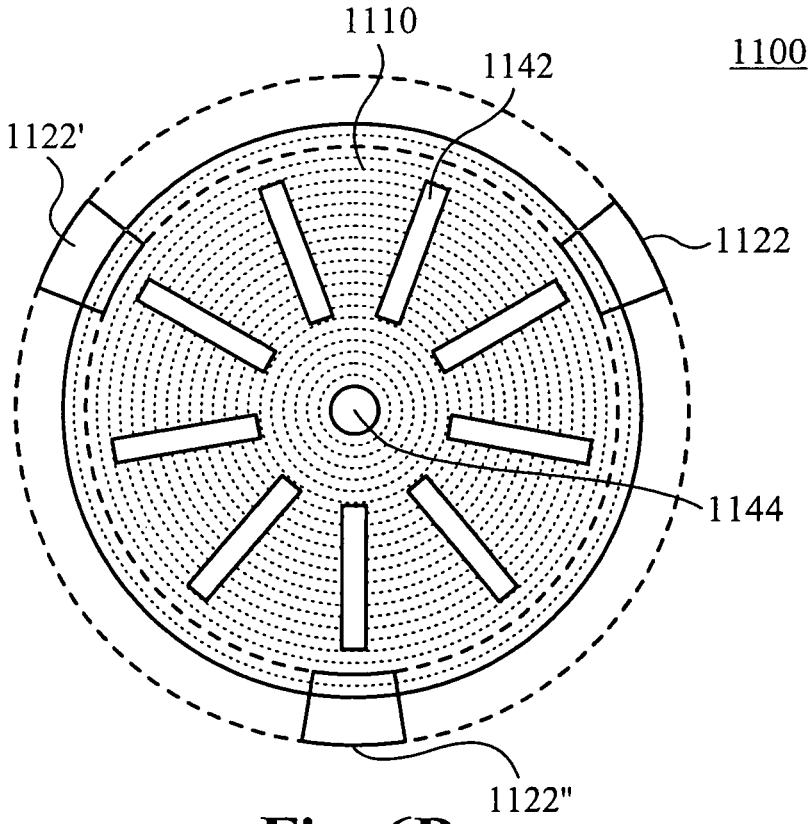
FIG. 6B is a top plan view of a cap structure of an alternative embodiment of a urinal splash prevention device in accordance with the present invention.

FIGS. 6A and 6B depict two different views of the cap structure 1100. As illustrated in FIG. 6A, the upstanding bristles 1110 extend from the lid surface 1140 in a direction substantially parallel to the wall surface 1130. Further, the retaining feet 1122 and 1122' extend below and radially outward from the base of the wall surface 1130. The lateral vent holes 1135 are disposed on the wall surface 1130 between the base of the wall surface 1130 and the lid surface 1140. Referring to FIG. 6B, the retaining feet 1122, 1122', and 1122" all extend radially outward from the wall surface 1130. Further, the lid surface 1140 contains two types of lid drain holes: a center drain hole 1144 and the radial drain holes 1142. These lid drain holes drain liquid from the urine impingement region of the lid surface 1140.

Base Structure

Figure 4:
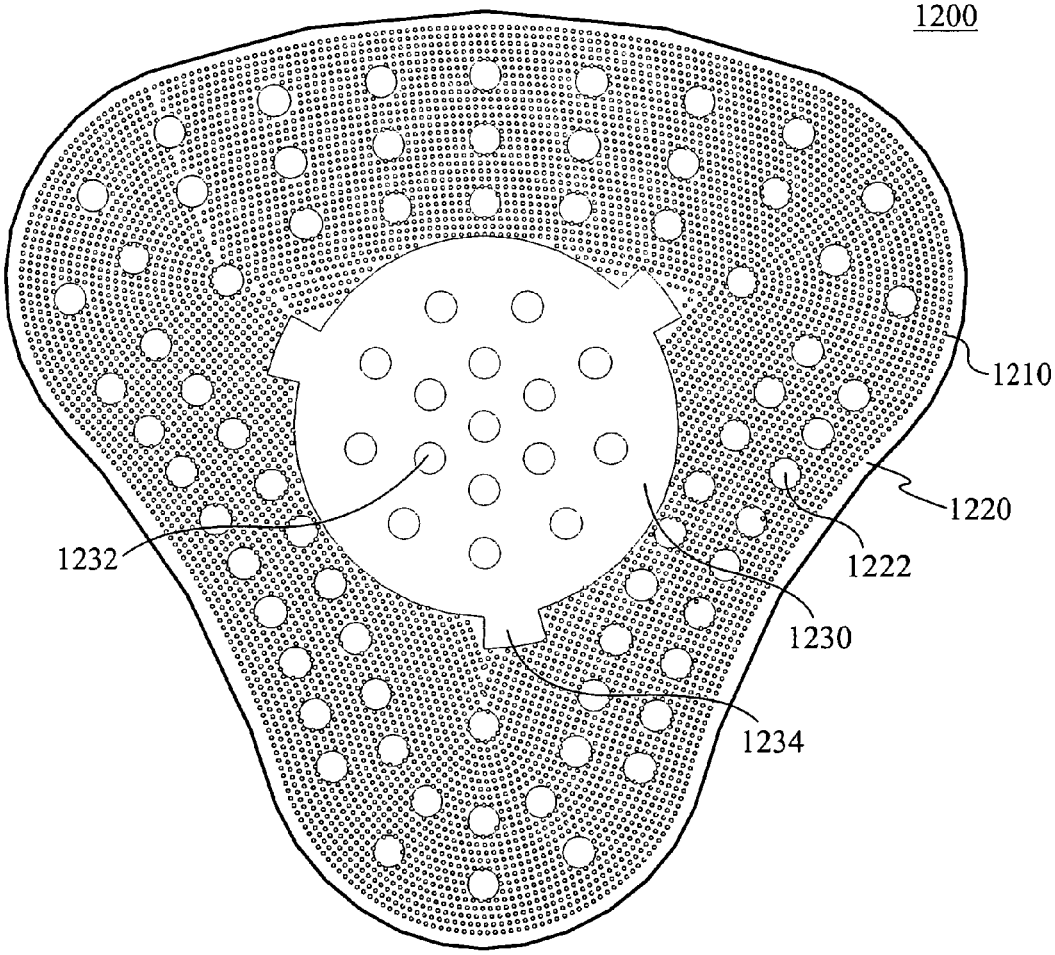
FIG. 4 is a top plan view of a base portion of an alternative embodiment of a urinal splash prevention device in accordance with the present invention.
Figure 5:
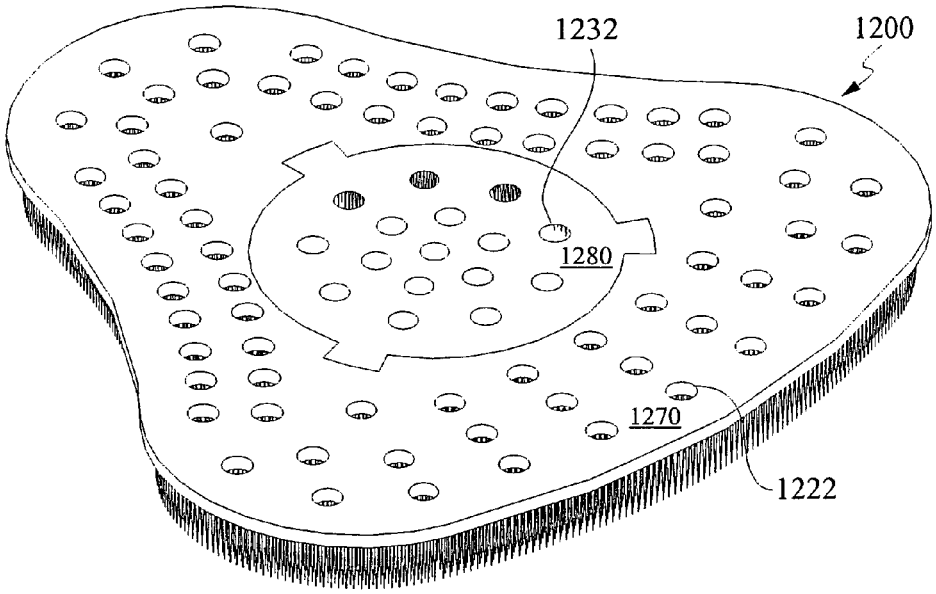
FIG. 5 is a bottom perspective view of an alternative embodiment of a urinal splash prevention device in accordance with the present invention.

Referring again to FIG. 2, the base structure 1200 includes an upper surface 1220, which includes a urine impingement region comprising the plurality of upstanding bristles 1210, and the cap retention surface 1230. The urine impingement region contains the primary drain holes 1222, while the cap-retention surface 1230 contains secondary drain holes 1232. Further, retention features 1234 are positioned between the cap retention surface 1230 and the upper surface 1220. FIG. 4 shows a plan view of the base structure 1200. As illustrated, three retention features 1234 are disposed evenly around the perimeter of the cap retention surface 1230. Preferably, the cap retention surface 1230 is recessed relative to the upper surface 1220. FIG. 5 shows a bottom perspective view of the base structure 1200. The base structure 1200 comprises bottom surfaces 1280 and 1270. Preferably the two lower surfaces are flush, though they can be raised or recessed relative to one another. The bottom surface 1280 is opposed to the cap retention surface 1230 and includes secondary drain holes 1232. The bottom surface 1270 is opposed to the upper surface 1220 and includes primary drain holes 1222.

Interface

Referring to FIGS. 2, 6A, and 6B, the cap structure 1100 and the base structure 1200 are configured to couple with one another so that the lower edge of the cap structure 1100 (the lower edge of the wall surface 1130) is closer to the cap retention surface 1230 than is the lid surface 1140 of the cap structure 1100. In this manner, the cap structure 1100 and the base structure 1200 form a hollowed volume 1300 therebetween. Preferably, the hollowed volume 1300 is configured to retain a urinal cake placed therein. Further, the lid drain holes 1144 and 1142, and the lateral vent holes 1135, form paths through the cap structure into the hollowed volume 1300 and then out, into the urinal drain (not shown). The secondary drain holes 1232 form paths through the base structure into the hollowed volume 1300 and then out, into the urinal drain.

In the embodiment illustrated in FIG. 2, the retaining feet 1122 are mated with the retaining features 1234. Although the illustrated embodiment shows a cap having three retaining feet and a base having three retaining features, any number of feet and corresponding retaining features can be used consistent with the present invention, so long as they accomplish the goal of coupling the cap structure to the base structure in the manner described above.

Assembled Device

Figure 3:
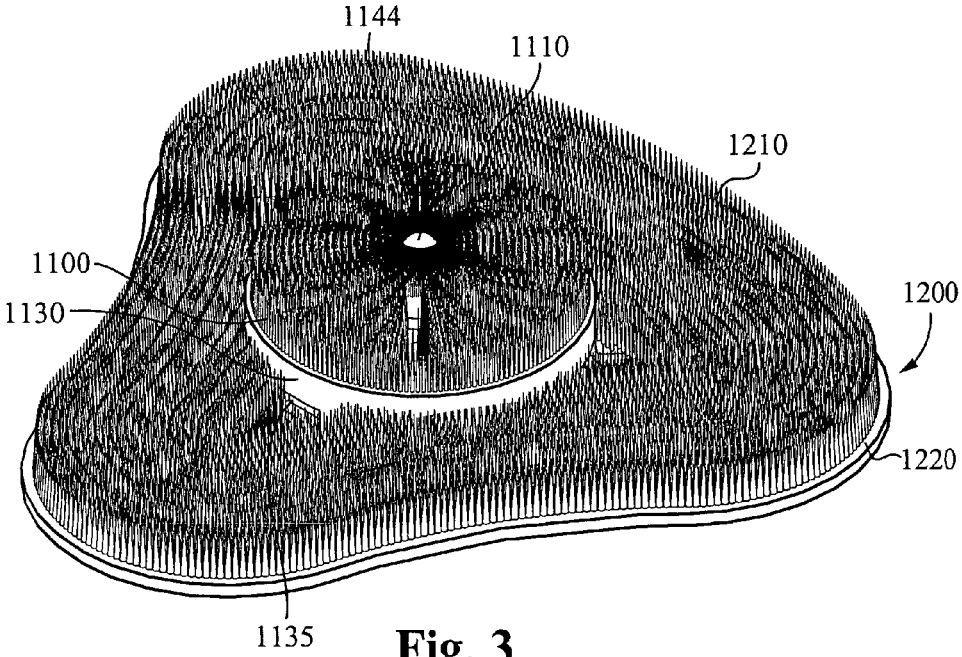
FIG. 3 is a top perspective assembled view of an alternative embodiment of a urinal splash prevention device in accordance with the present invention.

FIG. 3 illustrates the anti-splash device 1000 in an assembled state. The cap structure 1-100 is coupled to the base structure 1200 as described above. In the assembled state, the lid surface 1140 (e.g. of FIG. 2) and the upper surface 1220 are configured so that their upstanding bristles 1110 and 1210 are substantially parallel with one another. Further, the bristles 1110 are substantially parallel with the wall surface 1130 of the cap structure 1100. Thus, the urine impingement region of the cap structure 1100 and the urine impingement region of the base structure 1200 cover substantially all of the surfaces of the assembled anti-splash device 1000 that lie substantially in the plane of the upper surface 1220, with a notable exception being where they are punctuated by the drain holes 1142, 1144 and 1222 of FIGS. 2, 6A and 6B.

Function

In its preferred mode of operation, the anti-splash device 1000 is configured within a urinal so that a typical stream of urine will impinge upon its various urine impingement regions in a direction substantially parallel to the bristles 1110 and 1210. In this configuration, the wall surface 1130, being aligned parallel with the bristles of the various urine impingement regions, presents a relatively low profile to an impinging urine stream.

When a urine stream impacts a urine impingement region, the stream is broken up by the bristles of the region, and wicks down the bristles onto the region's supporting surface. There are a variety of constructions of the urine impingement regions consistent with the present invention that achieve this function: In some embodiments, each of the bristles has an appropriate thickness and flexibility such that it is configured to flex when struck by a typical stream of urine, wherein adjacent bristles are separated from one another by a distance such that the typical stream of urine contacting a bristle and causing it to flex will also contact at least two adjacent bristles and cause them to flex as well. In some embodiments, each of the bristles has a thickness and a height, wherein the thickness of each is less than one fifth of its height, and further wherein each bristle has at least three adjacent bristles within a distance of two times its thickness from it. In some embodiments, each of the bristles is elongated, and the bristles are configured densely enough that an imaginary circle having a radius equal to a stream of urine's mean radius, centered on a given bristle and drawn on the upper surface will include at least three other bristles within its boundary. In some embodiments, the bristles are configured to dissipate a large proportion of the kinetic energy of the urine stream using elements that are substantially parallel to the path of the urine stream.

Referring to FIGS. 6A and 6B, urine wicked onto the lid surface 1140 drains through the radial drain holes 1142 and/or center drain hole 1144. Referring to FIGS. 2 and 4, urine wicked onto the upper surface 1220 drains through the primary drain holes 1222.

Urine drained from the lid surface 1140 enters the void. Preferably, a urinal cake is disposed within the void so that urine entering the void from the lid surface 1140 washes over the urinal cake. Preferably, the urinal cake comprises chemicals chosen to minimize odor from urine. The vent holes 1135 serve primarily to permit volatile chemicals from the urinal cake to emanate from the void, though the various drain holes also permit this; the vent holes 1135 are not essential features of the illustrated embodiment.

From the void, urine is drained by the secondary drain holes 1232. Both these secondary drain holes 1232 and the primary drain holes 1222 allow urine to drain through the base structure 1200 and away from its bottom surfaces 1280 and 1270 (shown in FIG. 5) respectively.

Bottom Entry Configuration

Figure 7:
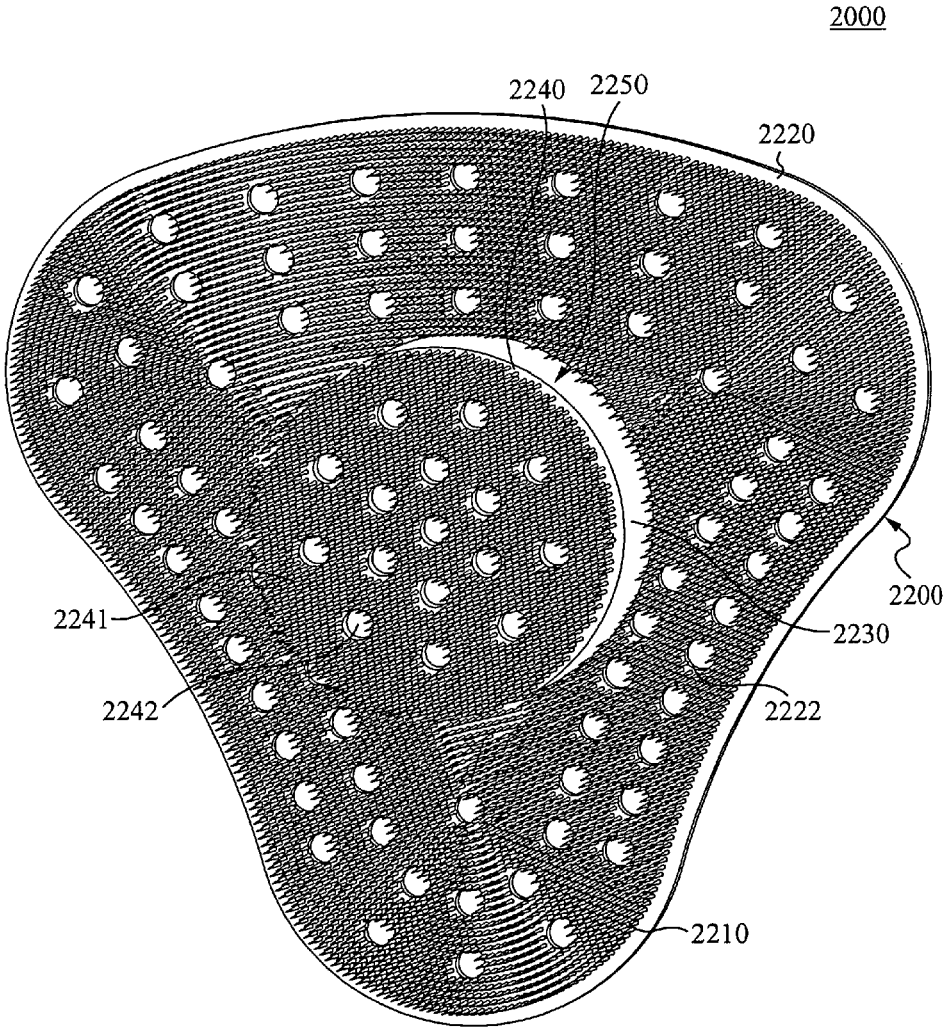
FIG. 7 is a top perspective view of the preferred embodiment of a urinal splash prevention device in accordance with the present invention.

FIG. 7 illustrates an anti-splash device 2000, an alternative embodiment of the present invention. The anti-splash device 2000 includes an upper structure 2200 and a retaining structure (2100 of FIG. 10).

Upper Structure

Referring to FIG. 7, the upper structure 2200 comprises a lower surface 2220 and the semi-cylindrical cap structure 2250. The lower surface 2220 includes a first urine impingement region comprising a plurality of upstanding bristles 2210, and a cap structure 2250 includes a lid surface 2240, which comprises a second urine impingement region comprising the plurality of upstanding bristles 2241, and the wall surface 2230.

Further, the upper structure 2200 includes three types of drain holes, including two on the cap structure 2250. The lower surface 2220 comprises the primary drain holes 2222. The lid surface 2240 comprises the lid drain holes 2242.

Figure 8:
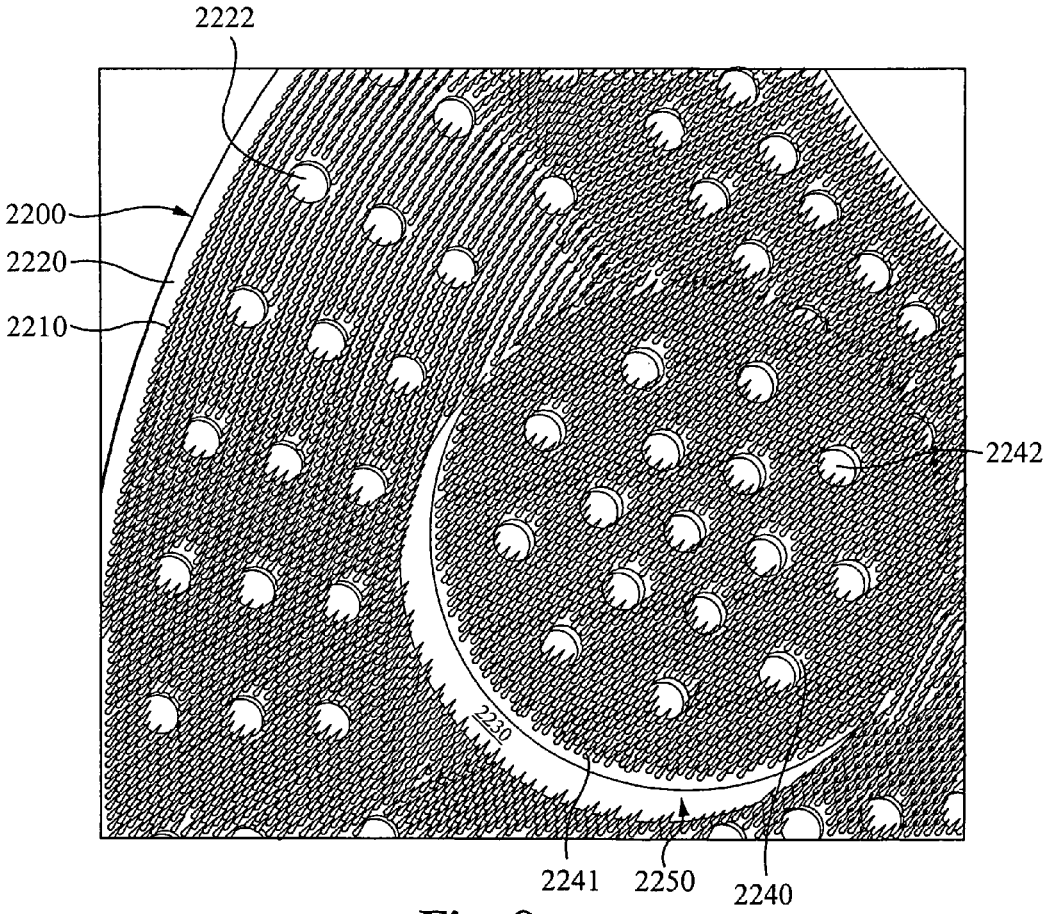
FIG. 8 is a detailed perspective view of the preferred embodiment of a urinal splash prevention device in accordance with the present invention.
Figure 9:
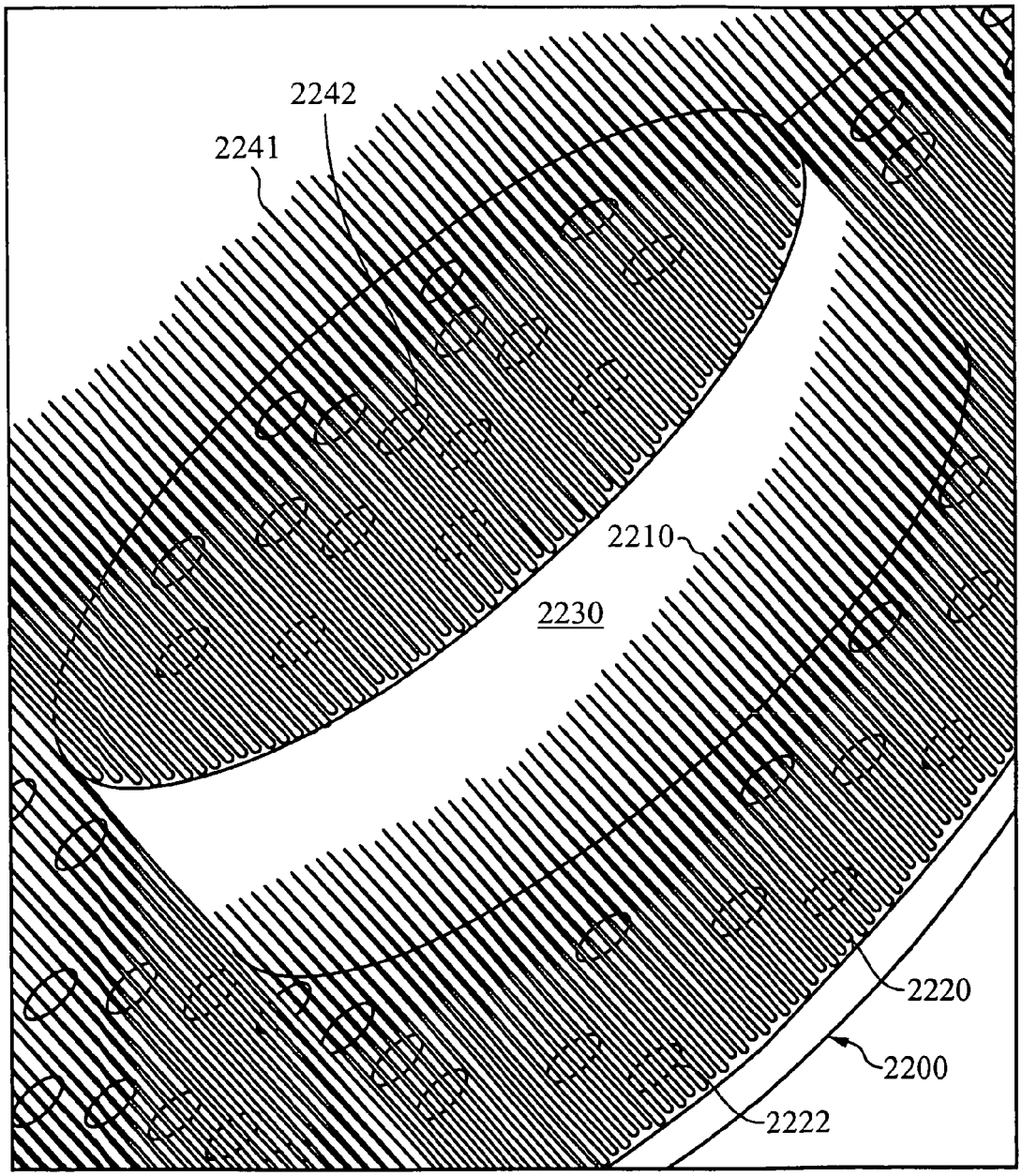
FIG. 9 is a detailed perspective view of the preferred embodiment of a urinal splash prevention device in accordance with the present invention.

Referring now to FIGS. 8 and 9, the lid surface 2140 and the lower surface 2220 are configured so that their upstanding bristles 2241 and 2210 are substantially parallel with one another. Further, the bristles 2241 and 2210 are substantially parallel with the wall surface 2230 of the cap structure 2250. Thus, the first urine impingement region and the second urine impingement region cover substantially all of the surfaces of the anti-splash device 2000 that lie in the plane of the lower surface 2220, with a notable exception being where they are punctuated by the drain holes 2242 and 2222. Preferably, and as illustrated, the cap structure 2250 and the lower surface 2220 are formed of a single piece of material. Alternatively, the two structures are formed of different pieces of material and joined at the lower edge of the wall surface 2230.

Figure 11:
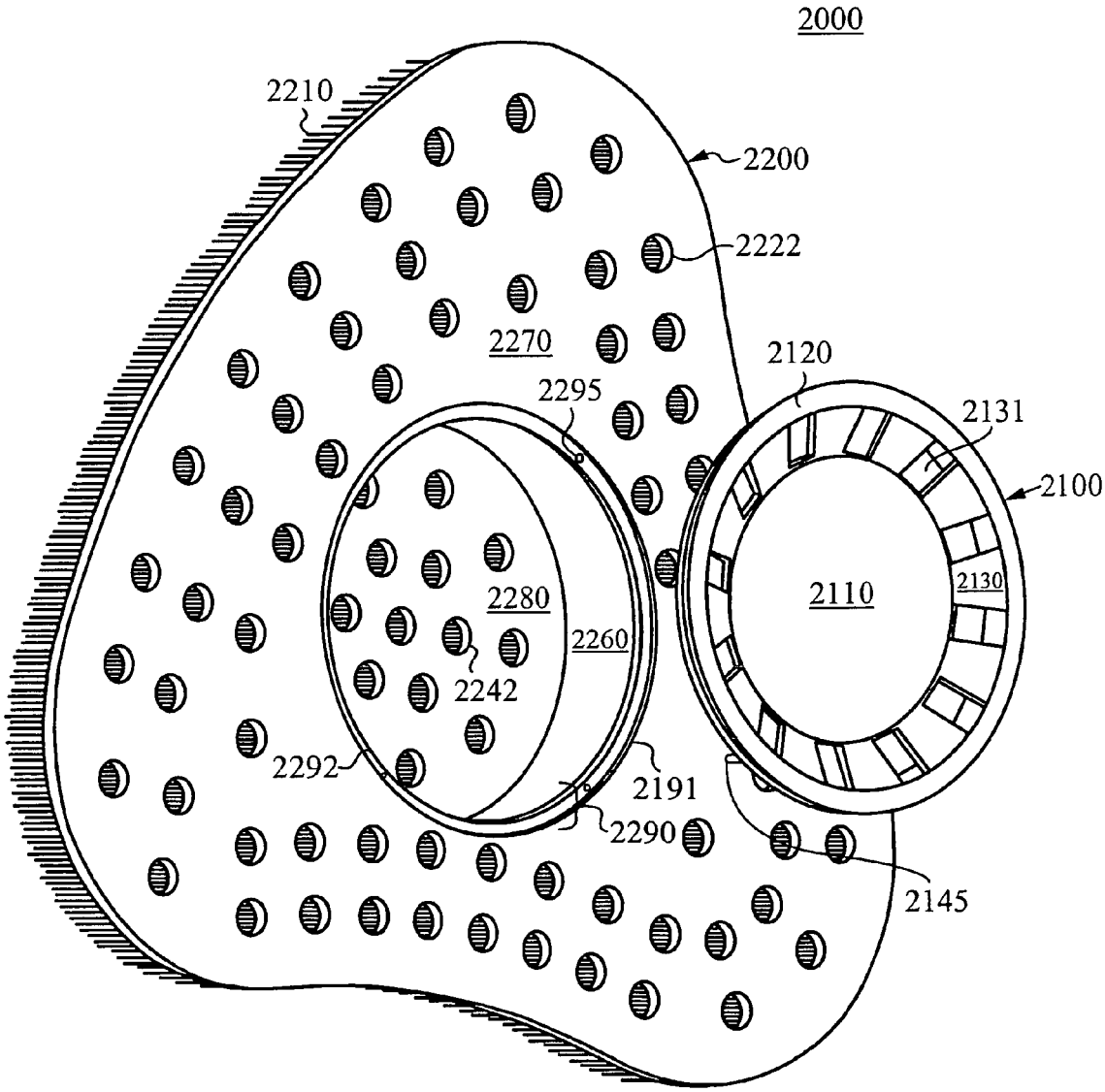
FIG. 11 is a bottom perspective exploded view of the preferred embodiment of a urinal splash prevention device in accordance with the present invention.

FIG. 11 shows a bottom perspective view of the upper structure 2200. The upper structure 2200 comprises inner surfaces 2280 and 2260, as well as a bottom surface 2270. As illustrated, the inner surfaces 2280 and 2260 correspond to lid surface 2240 and wall surface 2230 respectively. Accordingly, the inner surface 2280 includes apertures leading to drain holes 2242. The lower surface 2270 corresponds to the upper surface 2220 and includes apertures of primary drain holes 2222. The inner surfaces 2280 and 2260 form a cylindrical void. The lower surface 2270 surrounds a perimeter of that void.

Between the inner surface 2260 and the lower surface 2270, around the perimeter of the void formed by the inner surfaces, lies the retention region 2290. The retention region 2290 includes a circular inner edge 2292 and a circular outer edge 2291. The outer edge 2291 lies flush with the lower surface 2270, and the inner edge 2292 is recessed relative to the lower surface 2270, i.e. it does not lie on the plane of the lower surface 2270. Instead, the inner edge 2292 is disposed nearer to the inner surface 2280. Between the inner edge 2292 and the outer edge 2291 sits an annular surface that includes retention features 2295. In the illustrated embodiment, the retention features 2295 are cylindrical holes formed perpendicular to the annular surface and disposed evenly around it. Of course, consistent with the present invention, the retention features 2295 can have other constructions. These retention features 2295, and indeed the retention region 2290 in general, are configured to mate with the retaining structure 2100 illustrated in FIGS. 10, 11, and 12.

Retaining Structure

Figure 12:
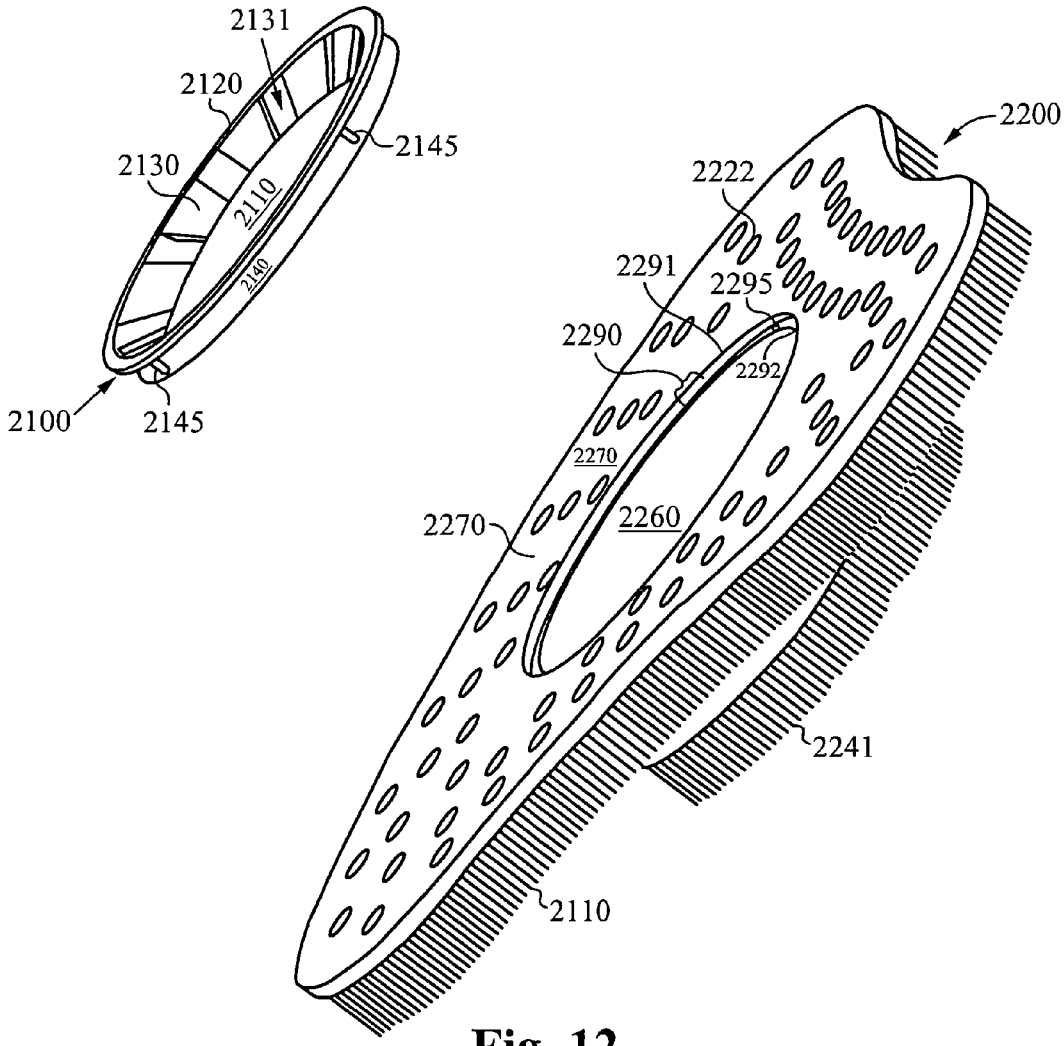
FIG. 12 is a side perspective exploded view of the preferred embodiment of a urinal splash prevention device in accordance with the present invention.

FIG. 12 shows a bottom perspective view of the retaining structure 2100 of FIG. 11; As illustrated, the retaining structure 2100 is generally circular in shape. It comprises a circular central portion 2110 and an annular outer portion 2120. The central portion 2110 is coupled to the outer portion 2120 by a plurality of spokes 2130 disposed evenly about the central portion 2110 to form secondary drain holes 2131 therebetween. The central portion 2110, the outer portion 2120, and two spokes 2130 bound each secondary drain hole 2131. At least two surfaces of the outer portion 2120 are disposed parallel to a surface of the central portion 2110, but preferably are not on the same plane (as illustrated).

Retention features 2145 are disposed evenly about the face of the outer portion 2120 parallel to and closest to the plane of the central portion 2110. A cylindrical face 2140 of the outer portion 2120 is disposed perpendicular to the central portion 2110.

Interface

The retaining structure 2100 and the upper structure 2200 are configured to couple with one another so that the central portion 2110 of the retaining structure 2100 is closer to the inner surface 2280 than is the annular portion 2120. In this manner, the retaining structure 2100 and the upper structure 2200 enclose the void formed by the inner surfaces 2280 and 2260. Preferably, this void is configured to retain a urinal cake placed therein. Further, the lid drain holes 2242 form paths through the upper structure 2220 into the void. The secondary drain holes 2131 form paths through the retaining structure into the void.

In the illustrated embodiment, the retaining features 2145, the face of the outer portion 2120 upon which they rest, and the cylindrical face 2140 of the outer portion 2120 of the retaining structure 2100 interface with the retention region 2290 of the upper structure 2200. When the two structures are coupled together, the cylindrical face 2140 sits flush with the inner surface 2260, while the retaining features 2145 are disposed within the retention features 2295. The face of the retention region 2290 upon which the retention features 2295 are disposed sits flush with the face of the retaining structure 2100 upon which the retaining features 2145 are disposed. Preferably, the retaining structure 2100 is held together with the upper structure 2200 in this configuration by an interference fit between the various features of the two structures.

Although the illustrated embodiment shows a retaining structure 2100 having three retaining features and an upper structure having three retention features, any number of retaining features and corresponding retention features can be used consistent with the present invention, so long as they accomplish the goal of coupling the upper structure to the base structure in the manner described above.

Assembled Device

Figure 10:
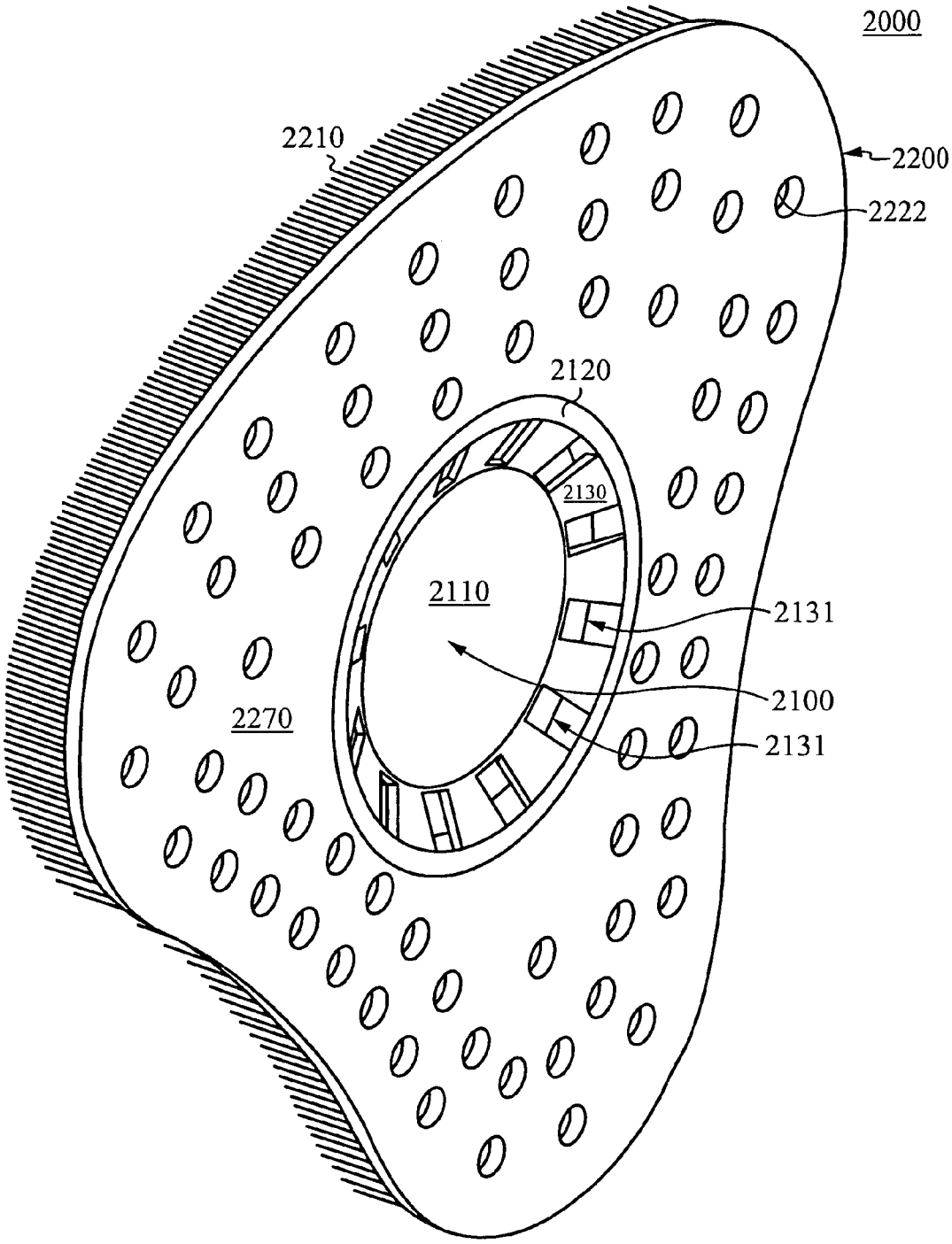
FIG. 10 is a bottom perspective assembled view of the preferred embodiment of a urinal splash prevention device in accordance with the present invention.

FIG. 10 illustrates the anti-splash device 2000 in an assembled state. The retaining structure 2100 is coupled to the upper structure 2200 as described above.

Function

Referring to FIGS. 7 and 8, in its preferred mode of operation, the anti-splash device 2000 is configured within a urinal so that a typical stream of urine will impinge upon its various urine impingement regions in a direction substantially parallel to the bristles 2241 and 2210. In this configuration, the wall surface 2230, being aligned parallel with the bristles of the various urine impingement regions, presents a relatively low profile to an impinging urine stream. As illustrated in FIGS. 8 and 9, the bristles of the various urine impingement regions can be rather short or quite long relative to the size of the cap structure 2250. The length and thickness of the bristles in this embodiment are chosen to achieve desired bristle characteristics relative to a typical urine stream. Thus, the type of material used to construct the embodiment influences the bristle characteristics.

When a urine stream impacts a urine impingement region, the stream is broken up by the bristles of the region, and wicks down the bristles onto the region's supporting surface. There are a variety of constructions of the urine impingement regions consistent with the present invention that achieve this function: In some embodiments, each of the bristles has an appropriate thickness and flexibility to configured to flex when struck by a typical stream of urine, wherein adjacent bristles are separated from one another by a distance such that the typical stream of urine contacting a bristle and causing it to flex will also contact at least two adjacent bristles and cause them to flex as well. In some embodiments, each of the bristles has a thickness and a height, wherein the thickness of each is less than one fifth of its height, and further wherein each bristle has at least three adjacent bristles within a distance of two times its thickness from it. In some embodiments, each of the bristles is elongated, and the bristles are configured densely enough that an imaginary circle having a radius equal to a stream of urine's mean radius, centered on a given bristle, and drawn on the upper surface will include at least three other bristles within its boundary. In some embodiments, the bristles are configured to dissipate a large proportion of the kinetic energy of the urine stream using elements that are substantially parallel to the path of the urine stream.

Still referring to FIGS. 8 and 9, urine wicked onto the lid surface 2240 drains through the drain holes 2242. Urine wicked onto the lower surface 2220 drains through the primary drain holes 2222.

Now referring to FIGS. 10, 11, and 12, urine drained from the lid surface 2240 enters the void. Preferably, a urinal cake is disposed within the void so that urine entering the void from the lid surface 2240 washes over the urinal cake. Preferably, the urinal cake comprises chemicals chosen to minimize odor from urine. The various drain holes permit volatile chemicals from the urinal cake to emanate from the void.

From the void, urine is drained by the secondary drain holes 2231 of the retaining structure 2100. These secondary drain holes 2231 permit urine to drain through the retaining structure 2100 and away from its surfaces. Similarly, the primary drain holes 2222 allow urine to drain through the upper structure 2200 and away from its lower surface 2270.

Other Embodiments

Some other embodiments of the present invention do not include features for holding urinal cakes. Preferably, these embodiments include implanted fragrance, deodorant, or anti-microbial chemicals that leech into the urinal over time and achieve a similar effect.

In some of these embodiments, drain holes are evenly distributed over a urinal mat, the upper surface of which comprises a urine impingement region. Preferably, the urine impingement region covers substantially the entire upper surface of the urinal mat, leaving only the apertures to the drain holes uncovered.

For example, referring to FIG. 4, a urinal mat consistent with this aspect of the present invention includes bristles 1210 not only on the surface 1220 as illustrated but also throughout the region 1230. In this example, the features 1234 are be eliminated.

When a urine stream impacts the urine impingement region, the stream is broken up by the bristles of the region, and wicks down the bristles onto the region's supporting surface. There are a variety of constructions of the urine impingement regions consistent with the present invention that achieve this function: In some embodiments, each of the bristles has an appropriate thickness and flexibility configured to flex when struck by a typical stream of urine, wherein adjacent bristles are separated from one another by a distance such that the typical stream of urine contacting a bristle and causing it to flex will also contact at least two adjacent bristles and cause them to flex as well. In some embodiments, each of the bristles has a thickness and a height, wherein the thickness of each is less than one fifth of its height, and further wherein each bristle has at least three adjacent bristles within a distance of two times its thickness from it. In some embodiments, each of the bristles is elongated, and the bristles are configured densely enough that an imaginary circle having a radius equal to a stream of urine's mean radius, centered on a given bristle, and drawn on the upper surface will include at least three other bristles within its boundary. In some embodiments, the bristles are configured to dissipate a large proportion of the kinetic energy of the urine stream using elements that are substantially parallel to the path of the urine stream.

In these embodiments, urine wicked onto the upper surface, e.g. 1220 or 1230 of FIG. 4, drains through the drain holes, e.g. 1222 or 1232. The drain holes of the upper surface 1220 preferably all lead directly to the lower surface of the urinal mat, permitting urine to drain through holes and away from the urinal mat's lower surface.

Figure 13:
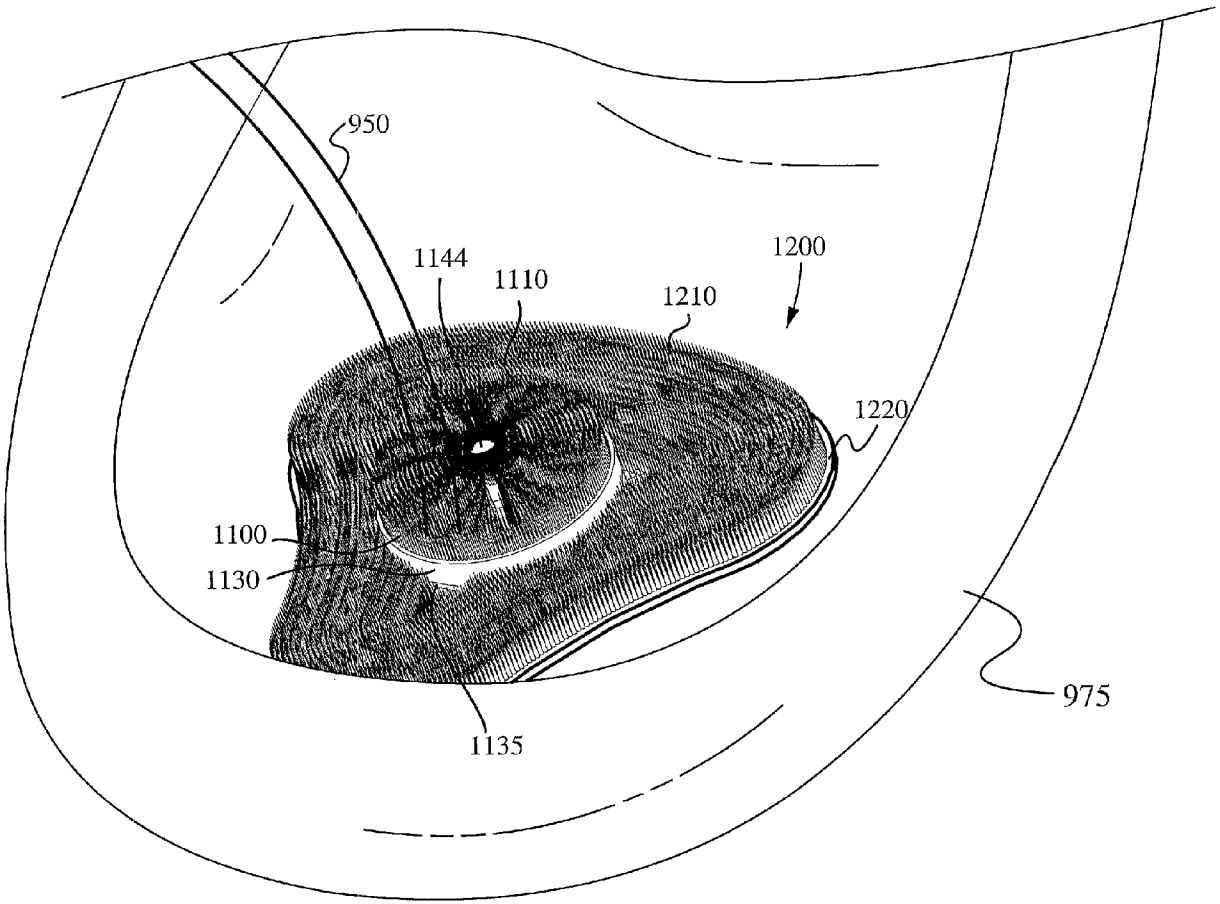
FIG. 13 is a perspective view of one embodiment of a urinal splash prevention device being used in a urinal in accordance with the present invention.

FIG. 13 is a perspective view of one embodiment of a urinal splash prevention device, such as the urinal splash prevention device 1200 of FIG. 3, being used in a urinal in accordance with the present invention. In FIG. 13, the urinal splash prevention device 1200 is disposed within urinal 975. A stream of urine 950 is intercepted by a urine impingement region of the urinal splash prevention device 1200.

The urinal splash prevention device 1200 is a mat or other object for attenuating reflective spray during use of a urinal. The device 1200 comprises a urine impingement region that includes a plurality of upstanding, flexible bristles. Preferably, the urine impingement region is disposed on an upper surface of a body configured for placement within a urinal and includes a sheet-like substrate having a plurality of drain holes. In some embodiments, the body is infused with an anti-microbial chemical that is configured to leech out into the urinal over time.

In some embodiments, a lower surface of the body is configured to rest on a surface of the urinal in which the mat is placed, and a hollowed volume is disposed between the lower surface and the upper surface and is configured to accept a urinal cake. In some embodiments, the device 1200 further comprises a retaining member configured to couple with the body and retain the urinal cake within the hollowed volume.

In some embodiments, the plurality of bristles are arranged within the urine impingement region in an ordered array. In some embodiments, the plurality of bristles are disposed within the urine impingement region in a disordered arrangement.

In one embodiment, a method of attenuating splashing caused by a stream of urine, such as stream 950, with a mean radius impinging on a urinal, such as urinal 975, comprises: intercepting the stream of urine with one of a first urine impingement region and a second urine impingement region of an object disposed within the urinal 975. The first urine impingement region is disposed on a sheet-like substrate and comprising a first plurality of upstanding, flexible bristles, each configured to flex when struck by a typical stream of urine, wherein adjacent bristles are separated from one another by a distance such that the typical stream of urine contacting a bristle and causing it to flex will also contact at least two adjacent bristles and cause them to flex as well. The second urine impingement region is disposed on a cap structure configured to accept a urinal cake. The cap structure comprises a lid surface and a lower edge, wherein the lid surface includes a plurality of drain holes formed therethrough and a second urine impingement region that includes a second plurality of upstanding, flexible bristles, with each bristle being configured to flex when struck by a typical stream of urine, and adjacent bristles are separated from one another by a distance such that the typical stream of urine contacting a bristle and causing it to flex will also contact at least two adjacent bristles and cause them to flex as well. The drain holes formed through the lid surface take up less than a majority of the area within the boundary of the lid surface. The lower edge is configured to mate with a urinal cake retention region on the upper surface of the sheet-like substrate, thereby permitting retention of a urinal cake therebetween. Urine is drained from the urine impingement region through an aperture. In some embodiments, the method further comprises directing urine from the first or second urine impingement region onto a urinal cake.

In another embodiment, a method of attenuating splashing caused by a stream of urine, such as stream 950, with a mean radius impinging on a urinal, such as urinal 975, comprises intercepting the stream of urine with a urine impingement region of an object disposed within the urinal. The urine impingement region comprises a plurality of upstanding flexible bristles, with each bristle having a thickness and a height. The thickness of each bristle is less than one fifth of a height of each bristle, and each bristle has at least three adjacent bristles within a distance of two times its thickness from it. Urine is drained from the urine impingement region through an aperture. In some embodiments, the method further comprises directing urine from the first or second urine impingement region onto a urinal cake.

In yet another embodiment, a method of attenuating splashing caused by a stream of urine, such as stream 950, with a mean radius impinging on a urinal, such as urinal 975, comprises intercepting the stream of urine with a urine impingement region of an object disposed within the urinal. The urine impingement region comprises a plurality of elongated, upstanding, flexible bristles configured densely enough that an imaginary circle having a radius equal to a mean radius of a stream of urine, centered on a given bristle, and drawn on the upper surface will include at least three other bristles within a boundary of the circle. The object is infused with an anti-microbial chemical. Urine is drained from the urine impingement region through an aperture, and the anti-microbial chemical is leeched out from the object into the urinal over time. In some embodiments, the method further comprises directing urine from the first or second urine impingement region onto a urinal cake.

Though the present invention has been described in the context of preventing splashing from a urinal, in some embodiments, the invention is adapted to reduce or prevent splashing in other contexts. For example, some embodiments are configured to reduce splashing during industrial liquid transfer and some embodiments are configured for use in a home or garden context.

The present invention has been described in terms of specific embodiments incorporating details to facilitate the understanding of the principles of construction and operation of the invention. Such reference herein to specific embodiments and details thereof is not intended to limit the scope of the claims appended hereto. It will be apparent to those skilled in the art that modifications may be made in the embodiments chosen for illustration without departing from the spirit and scope of the invention.

What is claimed is:

1. A splash attenuating urinal guard, comprising a base having an upper surface including a urine impingement region comprising a plurality of upstanding bristles, and a plurality of drain holes through the base, the upstanding bristles being substantially parallel, the bristles covering substantially all of the surfaces of the guard other than where it is punctuated by drain holes, and being configured so that at least three bristles wick down onto the urine impingement region of the upper surface to break UP a stream of urine when the urine impingement region is contacted by the stream of urine from a user of the urinal.

2. The splash attenuating urinal guard according to claim 1 wherein the bristles are at least five times taller than they are thick.

3. The splash attenuating urinal guard according to claim 2 wherein each bristle has at least three adjacent bristles within a distance of two times its thickness.

4. The splash attenuating urinal guard according to claim 1 wherein each bristle has at least three adjacent bristles within a distance of two times its thickness.

5. A splash attenuating urinal guard, comprising a base having an upper surface including a urine impingement region comprising a plurality of upstanding bristles, and a plurality of drain holes through the base, the upstanding bristles being substantially parallel, the bristles covering substantially all of the surfaces of the guard other than where it is punctuated by drain holes, wherein the bristles have a thickness, flexibility, and spacing such that when a bristle is struck by a stream of urine sufficient to make it wick down onto the urine impingement region of the upper surface to break UP the stream of urine, it contacts at least two adjacent bristles causing them to wick down onto the urine impingement region of the upper surface as well.

6. A splash attenuating urinal guard, comprising a base having an upper surface including a urine impingement region comprising a plurality of upstanding bristles at least five times taller than they are thick, arranged so that each bristle has at least three adjacent bristles within a distance of two times its thickness, and a plurality of drain holes through the base, the upstanding bristles being substantially parallel, the bristles covering substantially all of the surfaces of the guard other than where it is punctuated by drain holes, and being configured so that at least three bristles wick down onto the urine impingement region of the upper surface to break UP a stream of urine when the urine impingement region is contacted by the stream of urine from a user of the urinal.

7. A splash attenuating urinal guard, comprising a base having an upper surface including a urine impingement region comprising a plurality of upstanding bristles, and a plurality of drain holes through the base, the upstanding bristles being substantially parallel, the bristles being configured so that at least three bristles wick down onto the urine impingement region of the upper surface to break up a stream of urine when the urine impingement region is contacted by the stream of urine from a user of the urinal.

8. The splash attenuating urinal guard according to claim 7 wherein the bristles are at least five times taller than they are thick.

9. The splash attenuating urinal guard according to claim 8 wherein each bristle has at least three adjacent bristles within a distance of two times its thickness.

10. The splash attenuating urinal guard according to claim 7 wherein each bristle has at least three adjacent bristles within a distance of two times its thickness.

11. A splash attenuating urinal guard, comprising a base having an upper surface including a urine impingement region comprising a plurality of upstanding bristles, and a plurality of drain holes through the base, the upstanding bristles being substantially parallel, wherein the bristles have a thickness, flexibility, and spacing such that when a bristle is struck by a stream of urine sufficient to make it wick down onto the urine impingement region of the upper surface to break up the stream of urine, it contacts at least two adjacent bristles causing them to wick down onto the urine impingement region of the upper surface as well.

12. A splash attenuating urinal guard, comprising a base having an upper surface including a urine impingement region comprising a plurality of upstanding bristles at least five times taller than they are thick, arranged so that each bristle has at least three adjacent bristles within a distance of two times its thickness, and a plurality of drain holes through the base, the upstanding bristles being substantially parallel, the bristles being configured so that at least three bristles wick down onto the urine impingement region of the upper surface to break up a stream of urine when the urine impingement region is contacted by the stream of urine from a user of the urinal.

* * * * *